US012551772B2

(12) United States Patent
Frost

(10) Patent No.: US 12,551,772 B2
(45) Date of Patent: Feb. 17, 2026

(54) GOLF BALL ADDRESS TRAINING METHOD

(71) Applicant: Donald Frost, Andover, KS (US)

(72) Inventor: Donald Frost, Andover, KS (US)

( * ) Notice: Subject to any disclaimer, the term of this patent is extended or adjusted under 35 U.S.C. 154(b) by 294 days.

(21) Appl. No.: 18/199,263

(22) Filed: May 18, 2023

(65) Prior Publication Data

US 2023/0285831 A1 Sep. 14, 2023

(51) Int. Cl.
*A63B 69/36* (2006.01)

(52) U.S. Cl.
CPC ..... *A63B 69/3661* (2013.01); *A63B 69/3667* (2013.01); *A63B 2208/0204* (2013.01)

(58) Field of Classification Search
CPC ..... A63B 69/3661; A63B 69/3667; A63B 2208/0204; A63B 2071/024; A63B 2071/0694
USPC ..... 473/155, 218, 257, 266, 270, 272, 273, 473/278, 279, 40
See application file for complete search history.

(56) References Cited

U.S. PATENT DOCUMENTS 2,777,697 A * 1/1957 Crossot ..... A63B 69/3667 473/218
4,000,905 A * 1/1977 Shirhall ..... A63B 69/3667 473/218
4,101,130 A 7/1978 Richards
4,164,352 A * 8/1979 O'Brien ..... A63B 69/3667 473/218
4,248,431 A 2/1981 Burnes
4,355,810 A * 10/1982 Rydeck ..... A63B 69/3661 473/218
4,384,718 A 5/1983 Cachola
4,434,983 A 3/1984 Taggart
4,583,739 A 4/1986 Kabbany
(Continued)

FOREIGN PATENT DOCUMENTS

WO WO87/00762 2/1987
WO WO92/17248 10/1992
(Continued)

OTHER PUBLICATIONS

ForeMat Training Mat, golfforemat.com. Accessed Nov. 20, 2022. https://golfforemat.com/product/foremat-training-mat/.
(Continued)

*Primary Examiner* — Nini F Legesse
(74) *Attorney, Agent, or Firm* — Kenneth H. Jack; Davis & Jack, L.L.C.

(57) ABSTRACT

A golf ball address training method including steps of providing a club set and a ground mat having a lateral line, selecting a highest loft club, orienting the lateral line up-range, and aligning an up-range foot with the lateral line, alternatively selecting a lowest loft club, orienting the lateral line down-range, and aligning a down-range foot with the lateral line, alternatively selecting a lowest high loft club, orienting the lateral line up-range, and placing the up-range foot a greatest distance up-range, alternatively selecting a highest low loft club, orienting the lateral line down-range, and placing the down-range foot a greatest distance down-range, alternatively selecting low or high loft intermediate clubs, correspondingly orienting the lateral line down-range or up-range, and correspondingly intermediately placing the down-range and up-range feet.

9 Claims, 11 Drawing Sheets

(56) References Cited

U.S. PATENT DOCUMENTS

| | | | | |
|---|---|---|---|---|
| 4,915,387 | A * | 4/1990 | Baxstrom | A63B 69/36 473/270 |
| 5,131,659 | A | 7/1992 | Lindberg, Jr. | |
| 5,306,011 | A * | 4/1994 | Perry | A63B 69/3667 473/218 |
| D359,366 | S | 6/1995 | DeLapp et al. | |
| 5,482,284 | A | 1/1996 | Vanderver | |
| 6,077,169 | A * | 6/2000 | Florian | A63B 69/3661 473/270 |
| 6,312,345 | B1 | 11/2001 | Pelz | |
| 6,482,102 | B2 * | 11/2002 | Grabowski | A63B 69/3667 473/270 |
| 6,592,376 | B1 * | 7/2003 | Carpenter | A63B 24/0003 473/409 |
| 6,821,210 | B2 * | 11/2004 | Kallage, Jr. | A63B 69/3667 473/218 |
| D509,873 | S | 9/2005 | Dias | |
| 7,037,210 | B2 | 5/2006 | Bainter | |
| 7,081,054 | B1 | 7/2006 | Nikkel | |
| 7,112,144 | B2 | 9/2006 | Mindlin | |
| 7,607,987 | B2 | 10/2009 | Alter | |
| 7,648,423 | B2 * | 1/2010 | Levis, Jr. | A63B 69/3667 473/270 |
| 8,747,243 | B2 | 6/2014 | Gibbs et al. | |
| 8,758,150 | B1 * | 6/2014 | Parker | A63B 69/3667 473/218 |
| 2001/0003104 | A1 | 6/2001 | Binduga | |
| 2013/0337928 | A1 * | 12/2013 | Scott | A63B 69/3661 473/218 |
| 2014/0378240 | A1 | 12/2014 | Parker | |
| 2016/0346660 | A1 | 12/2016 | Johnson | |

FOREIGN PATENT DOCUMENTS

| | | |
|---|---|---|
| WO | WO97/32634 | 9/1997 |
| WO | WO1998/06463 | 2/1998 |

OTHER PUBLICATIONS

Pure Pitch Hitting Mat, callawaytag.com. Accessed Nov. 20, 2022. https://callawaytag.com/products/pure-pitch-hitting-mat.

Acu-Strike Impact Mats for Outdoor and Indoor Golf Training, acustrikegolf.com. Accessed Nov. 20, 2022. https://acustrikegolf.com/two-mat-golf-training-set/.

Forb Golf Teaching Mat [5ft×5ft], forbgolf.com. Accessed: Nov. 25, 2022. https://www.forbgolf.com/forb-driving-range-golf-training-mat.

* cited by examiner

GOLF BALL ADDRESS TRAINING METHOD

FIELD OF THE INVENTION

This invention relates to methods for training golfers to properly establish foot and ball placements upon addressing a golf ball in preparation for striking the ball. More particularly, this invention relates to such methods which include a provision of a ground mat having foot placement and ball placement guiding indicia.

BACKGROUND OF THE INVENTION

Golfers commonly utilize a numbered set of golf clubs having a correlating ordered progression of loft angles or club face angles. Such clubs sets also commonly include an ordered progression of club shaft lengths which inversely correlate with the clubs' loft angles. Such club set may comprise a driver or one wood, fairway woods including a three wood, a five wood, and a seven wood, irons including a one iron, a two iron, a three iron, a four iron, a five iron, a six iron, a seven iron, an eight iron, and a nine iron, and wedge clubs including a pitching wedge, a gap wedge, a sand wedge, and a lob wedge. One or more putters are also typically included within the club set.

It is uncommon for a golfer to include all of such clubs in an actively played club set. An exemplary club set within a golfer's actively used bag of clubs may comprise a driver (D), a three wood (3W), a five wood (5W), a three iron (3I), a four iron (4I), a five iron (5I), a six iron (6I), a seven iron (7I), an eight iron (8I), a nine iron (9I), and a pitching wedge (PW). In such exemplary active golf club set, the pitching wedge would typically have a highest loft angle and the driver would have the lowest loft angle.

The ordered progression of loft angles (LA) of such club set, e.g., such set {D, 3W, 5W, 3I, 4I, 5I, 6I, 7I, 8I, 9I, PW}, may be expressed by the equation: $D_{LA}<3W_{LA}<5W_{LA}<3I_{LA}<4I_{LA}<5I_{LA}<6I_{LA}<7I_{LA}<8I_{LA}<9I_{LA}<PW_{LA}$, where the "LA" subscripts indicate the clubs' loft angles. The ordered progression of such club set's shaft lengths may be similarly represented by the equation: $D_{SL}>3W_{SL}>5W_{SL}>3I_{SL}>4I_{SL}>5I_{SL}>6I_{SL}>7I_{SL}>8I_{SL}>9I_{SL}>PW_{SL}$, where the "SL" subscripts represent the clubs' shaft lengths.

It may be seen in the above equations that the exemplarily club set's loft angles and shaft lengths are inversely related to each other such that the driver has a least loft angle and a greatest shaft length, and such that the pitching wedge has a greatest loft angle and a least shaft length. Such inverse ordered progressions of club characteristics are naturally reflected in similar inverse progressions of ball and foot placements established in the golfer's addresses of the ball with the various clubs.

Where the golfer utilizing such exemplary eleven club set properly addresses a golf ball, such ordered and inversely related dimensional progressions of foot and ball placements may be readily observed. In such ball addresses, the perpendicular distance from a line between the golfer's toes and the golf ball may be described as a reach distance. Also in such ball addresses, the position of the golfers' body down-range from or with respect to the ball may be described as the golfer's down-range position. Where the golfer addresses the ball with her pitching wedge, the reach is typically at a minimum, such minimum reach being consistent with the club's shortest shaft length. Also in such pitching wedge ball address, the golfer's down-range body position relative to the ball is at a maximum. In many circumstances a golfer's pitching wedge ball address aligns her up-range toe with the ball, such toe alignment positioning virtually the entirety of her body down-range with respect to the ball.

Alternatively, where the golfer addresses the ball with her driver, the reach is, consistently with the driver's maximum shaft length, at a maximum. In such driver ball address, the golfer's down-range body position relative to the ball is typically at a minimum or substantially zero distance in relation to the ball. In many circumstances, the golfer's driver ball address aligns her down-range toe with the ball, and positions virtually the entirety of her body up-range from the ball.

In addressing the ball with other clubs among the exemplary eleven club set, ordered and inverse progressions of reach and down-range body position are observed and complied with in order to achieve a proper stance in relation to both the ball and the selected club. The ordered progression of body down-range positioning may be expressed by the equation: $D_{DR}<3W_{DR}<5W_{DR}<3I_{DR}<4I_{DR}<5I_{DR}<6I_{DR}<7I_{DR}<8I_{DR}<9I_{DR}<PW_{DR}$, where the "DR" subscripts indicate the distance the golfer's body is displaced down-range in relation to the golf ball's position. The reach components of such ball addressing stances may be expressed by the equation:

$D_R>3W_R>5W_R>3I_R>4I_R>5I_R>6I_R>7I_R>8I_R>9I_R>PW_R$, where the "R" subscripts indicate the reach distance of the ball from the golfer.

Where the golfer is a novice, and where, for example, she addresses a golf ball with her five iron, she may mistakenly set the down-range position of her body in relation to the ball at a position which is close to a proper $6I_{DR}$ position or close to a proper $4I_{DR}$ position. Also, in such ball address, the golfer may similarly mistakenly set the reach component of the stance too near or too far. Such body and ball positioning mistakes and discrepancies undesirably interfere with or deter the golfer's efforts to grove her swing in use of her various clubs. Where the novice golfer commits such errors in setting her ball addressing body position and ball placement, further errors are commonly precipitated in the golfer's addresses of the ball with other clubs.

The instant inventive golf ball address training method solves or ameliorates the above described stance and ball address problems and errors by providing a specialized ground mat and by providing usage steps which allow the golfer to easily perceive, relative to the mat, proper stances in addressing a golf ball with various golf clubs. In use of the inventive method, the proper ordered progression of down-range body positions are easily perceived as linear progressions of foot placements in relation to a lateral line upon the mat. Also, in performance of the method, the ordered progression of reach distances is easily perceived as progressive distances of the ball from a mat edge.

BRIEF SUMMARY OF THE INVENTION

The instant inventive method for training a golfer's golf ball address includes steps of providing a rectangular and longitudinally oblongated ground mat having an off center lateral line.

In the method, the golfer utilizes an ordered set of golf clubs, typically including a driver, fairway woods, irons, and a wedge or wedges.

Also in the method, the golfer divides her club set into two subsets, a low loft club series and a high loft club series.

Also, in the method, the golfer orients and re-orients the ground mat so that its lateral line is in a down-range position during the golfer's training with the low loft series' clubs, and is oppositely oriented at an up-range position during training with the high loft series' clubs.

During training with the high loft clubs, the golfer's up-range foot is progressively placed and re-placed up-range in relation to the up-range positioned lateral line. During the golfer's training with the low loft clubs, the golfer's down-range foot is mirroringly progressively placed and re-placed down-range in relation to the down-range positioned lateral line.

The inventive method allows the golfer's up-range and down-range feet to be consistently accurately placed at proper ball address positions during training with the respectively high loft club series' highest loft club and the low loft club series' lowest loft club.

Such high and low loft club respectively include a lowest and a highest loft club. According to the inventive method, greatest up-range and greatest down-range placements of the golfer's up-range and down-range feet in relation to the alternatively up-range and down-range positioned lateral line.

Under the method, ordered subprogressions of foot placements are established for each club series intermediate clubs, such foot placement subprogressions being framed and guided by the high and low loft placements associated by the low and high loft series.

In use of the method, the golfer easily perceives all proper foot placements in relation to the mat's lateral use during practice with all of her clubs, such training and practice beneficially translating to regular golf play without the assistance of the mat and the method.

The method additionally beneficially guides ball placement in relation to the guided foot placements discussed above by requiring that the ball be aligned with the lateral line.

The method also beneficially guides reach distance placement of golf ball. Where a golfer improperly or mistakenly varies her knee flex, back position and/or grip position during her golf ball address, such discrepancies may be visually detected by the golfer as a variance in the method's ordered progression of reach distance ball placements.

Accordingly, objects of the instant invention include the establishment and performance of a method for training a golfer's golf ball address which incorporates steps as described above, and which arranges and orders those steps as described above.

Other and further objects, benefits, and advantages of the instant invention will become known to those skilled in the art upon review of the Detailed Description which follows, and upon review of the appended drawings.

DETAILED DESCRIPTION OF A PREFERRED MODE OF PERFORMANCE OF METHOD

Figure 1:
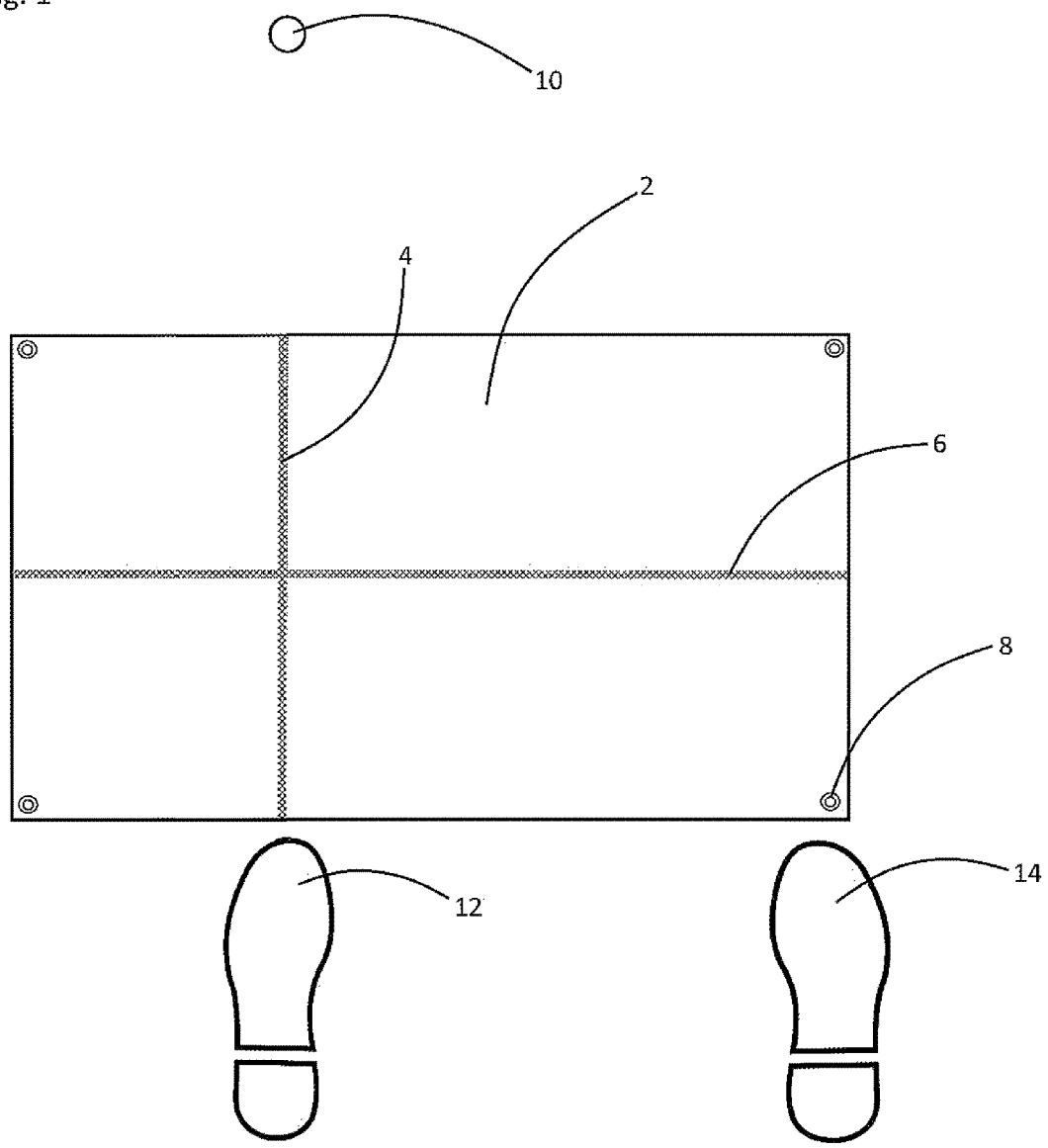
FIG. 1 is a diagram showing utilization of the instant inventive method in training of a golfer's ball address while using a driver.

The instant inventive method is intended for use in training novice golfers in properly addressing a golf ball while using various golf clubs from the golfer's club set. In a preferred mode of performance of the method, the golfer either owns or has access to a golf club set, such set preferably comprising at least a lowest loft club such as a driver, a highest loft club such as a pitching wedge, an adjacently numbered pair of intermediate clubs such as a five iron and six iron, an intermediate low loft club, such as a three iron, between the driver and the five iron, and an intermediate high loft club, such as an eight iron, between the six iron and pitching wedge.

Accordingly, a preferred minimum number of clubs utilized in performance of the instant inventive method entails selection and training use of at least six clubs from a golfer's club set. Upon the exemplary selections of the driver, three iron, five iron, six iron, eight iron, and pitching wedge clubs, the golfer designates or recognizes the driver, three iron, and five iron clubs as constituting a low loft club series, and designates or recognizes the six iron, eight iron, and pitching wedge clubs as a high loft club series. In such club series, the driver constitutes a lowest loft club among the low loft club series, the five iron constitutes a highest loft club among the low loft club series, the three iron constitutes an intermediate loft club among the low loft club series, the six iron constitutes a lowest loft club among the high loft club series, the pitching wedge constitutes a highest loft club among the high loft club series, and the eight iron constitutes an intermediate loft club among the high loft club series.

A plurality of second intermediate clubs, such as a three wood, a five wood, and a four iron may be additionally selected and included as members of the low loft club series. Correspondingly, another plurality of intermediate clubs such a seven iron, and a nine iron may be additionally selected and included by the golfer as members of the high loft club series.

In a further step of the instant inventive method, the golfer provides and uses a flexible ground mat 2 which is preferably rectangular, longitudinally oblongated, and has substantially straight edges. In a suitable embodiment, the ground mat 2 may be composed of a rectangular section of indoor/outdoor carpeting. In Drawing FIGS. 1-11, ground mat 2 is representative of such rectangular mat, and in the preferred embodiment, such mat has a lateral line 4 and has a longitudinally extending aim line 6 which substantially perpendicularly intersects the lateral line 4.

In the preferred embodiment, the lateral line 4 is spaced away from the mat's longitudinal midpoint so that the line 4 may be easily visually perceived by the golfer as being spaced away from the mat's longitudinal midpoint. Upon aligning the aim line 6 with a down-range target, the lateral line 4 is preferably readily viewed by the golfer as being displaced up-range or down-range from the midpoint. In a preferred embodiment, the ground mat 2 has golf tee receiving eyes 8 at its four corners, such eyes allowing the mat 2 to be conveniently staked by golf tees to the ground.

In performance of the instant inventive method, the golfer may repeatedly and successively select clubs from the high loft and low loft series of clubs which the golfer has identified as subsets of her golf club set. Upon each selection of a club from the high loft series, the golfer orients the mat 2 upon the ground so that the lateral line 2 is up-range from the mat's longitudinal midpoint, as indicated in FIGS. 7-11. Upon club selections from the low loft series, the mat 2 is reversed, moving the lateral line 4 down-range as indicated in FIGS. 1-6. Accordingly, as the golfer selects and trains her use of her various clubs, she orients and re-orients the mat 2 so that the lateral line 4 is always down-range while low loft series clubs are wielded, and so that such line is up-range while high loft series clubs are wielded.

Figure 11:
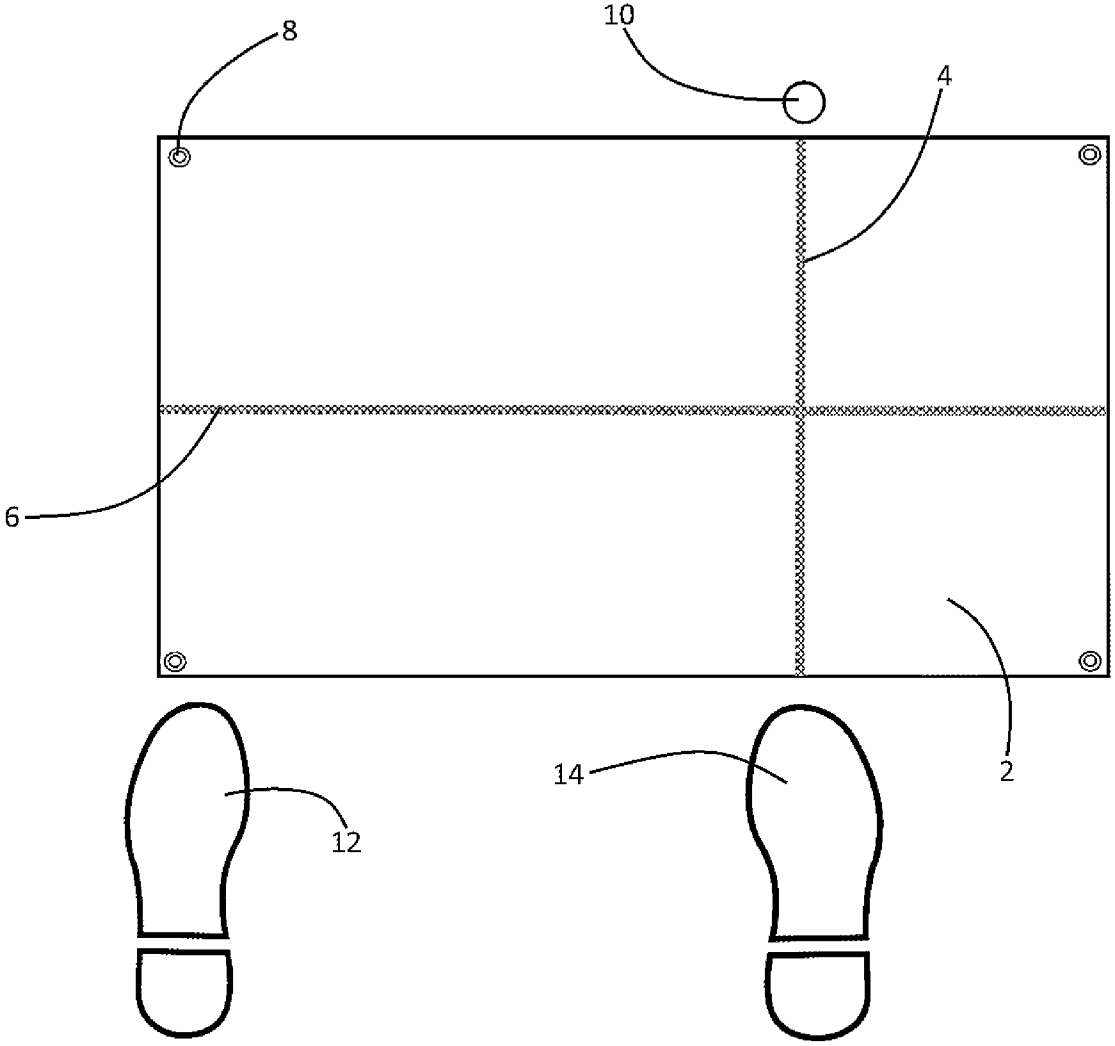
FIG. 11 is a diagram showing utilization of the instant inventive method in training of a golfer's ball address while alternatively using a pitching wedge.

Upon selecting the pitching wedge for training use, the golfer necessarily establishes and maintains a ground mat orientation wherein, as indicated in FIG. 11, the mat's lateral line 4 is positioned up-range from the mat's longitudinal midpoint. Thereafter, the golfer may align the mat 2 and its aim line 6 so that it points toward a down-range target. Thereafter, the golfer may extend golf tees 8 through eye grommets in order to securely anchor the mat 2 upon the ground.

Thereafter, the golfer may place a golf ball 10 in alignment with the lateral line 4 and at a closest position with respect to the mat 2 and the golfer. Thereafter, the golfer may place her up-range foot 14 adjacent the near edge of the mat 2 and in substantial alignment with the lateral line 4. Upon such aligned placement of the up-range foot 14, the golfer's down-range foot 12 is preferably placed in alignment with the straight edge of the mat, such placement establishing a comfortable and approximate shoulder width stance.

The perpendicular distance between a lateral line extending between the toes of the golfer's shoes 12 and 14, and the ball 10 constitutes a reach distance. In many cases, the reach is properly determined by factors such as the length of the club shaft, the comfortable bend in the golfer's knees, straightness of the golfer's back, and a correct placement of the golfer's grip of the club beneath the golfer's chin. Since the shaft length of the high loft series highest high loft club, e.g. the pitching wedge, is commonly less than that of other clubs among the set, such factors typically require that the reach distance during use of the pitching wedge be less than the reach distance established in use of other clubs among the set. Conversely, the reach associated with the low loft series' lowest loft club, e.g. the driver, is greater than the reach established for all other clubs.

Upon selecting the highest loft club among the high loft series, the golfer may anchor the mat 2 so that the lateral line 4 is at its up-range position. Thereafer, the golfer may position her up-range foot 14 in alignment with lateral line 4, closely adjacent the edge of the mat 2, and the golfer may place the ball 10 in alignment with the lateral line 4 at such closest or least reach distance from the opposite edge of the mat 2.

The ball position and foot positions shown in FIG. 11 are graphically symbolic of a properly ball address while wielding the high loft club series highest loft club, e.g. the pitching wedge. The factors of alignment of the golfer's up-range foot 14 with line 4, alignment of the ball 10 with line 4, and placement of the ball 10 at the least a distance from the golfer and the mat 2 beneficially assist the golfer in replicating those positions during use of such club without the mat 2.

Alternatively, the golfer may select the low loft club series lowest loft clug, e.g. her driver, for golf swing training. As indicated in FIG. 1, such selection entails reanchoring and maintaining the ground mat 2 at an orientation wherein lateral line 4 is down-range from the mat's longitudinal midpoint. In addressing the golf ball 10, the golfer aligns her down-range foot 12 adjacent the mat 2 and in substantial alignment with the repositioned lateral line 4. Thereafter, the golfer places the golf ball 10 upon the ground in substantial alignment with the lateral line 4. In such placement, as a result of the maximum shaft length of the driver, such placement is typically maximally displaces the golf ball from the golfer and the mat 2.

Similarly with the graphic symbolism of FIG. 11's mat, foot placements, and ball placement, the corresponding positions shown in FIG. 1 symbolize a correct ball address upon wielding and training with the low loft club series' lowest loft club. The alignment of the down-range foot 12 with lateral line 4 serves as an accurate and easily visualizable guide during subsequent uses of the driver without the mat 2. FIG. 1's maximally distant placement of the ball 10 aids in establishing a proper distance in use of other clubs by framing the spectrum of ball placements from FIG. 11's least reach to FIG. 1's greatest reach.

Figure 7:
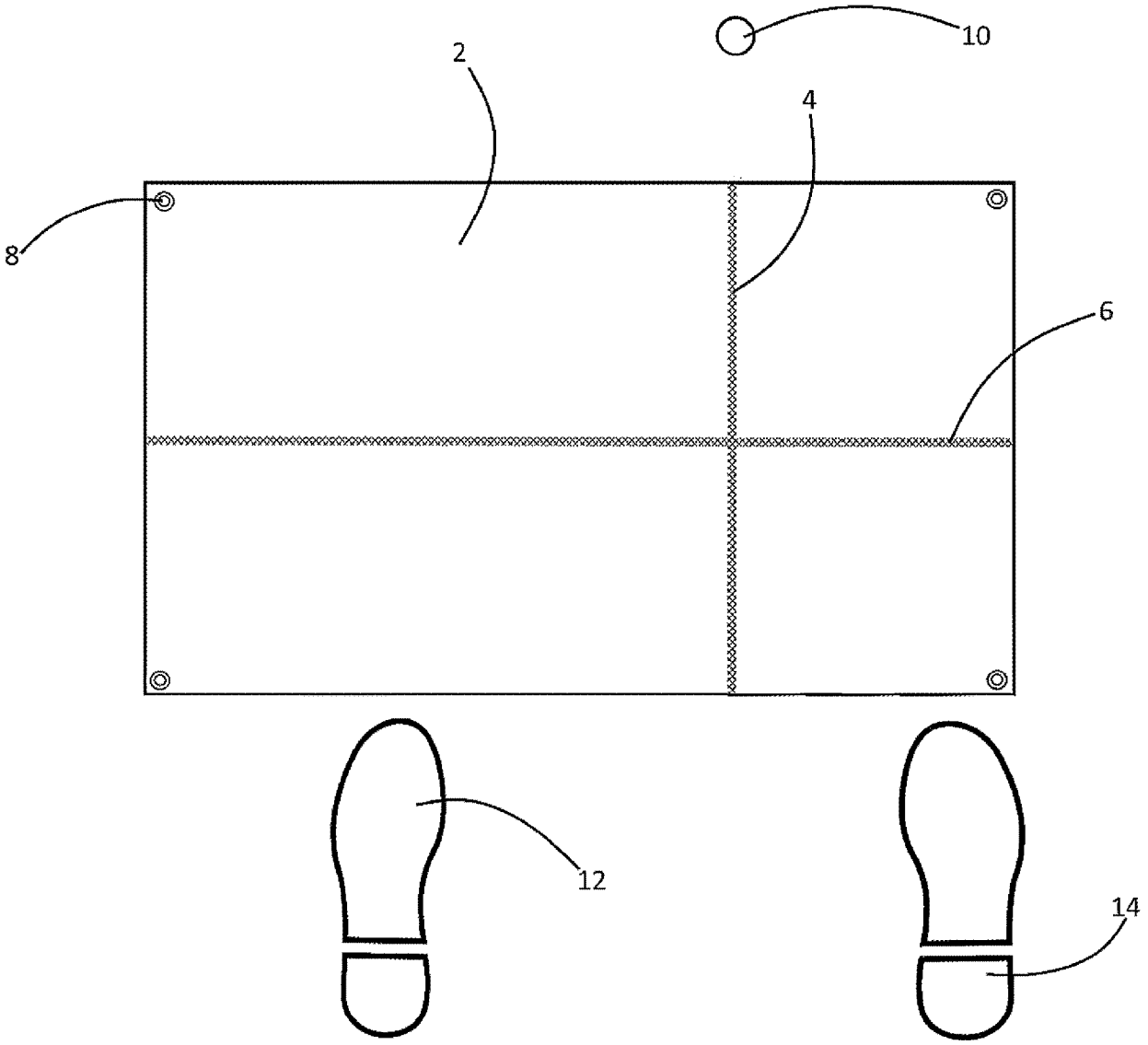
FIG. 7 is a diagram showing utilization of the instant inventive method in training of a golfer's ball address while alternatively using a six iron.

Referring to FIG. 7, in an alternative selection of the high loft club series' lowest loft club, e.g. the golfer's six iron, the lateral line 4 is oriented up-range with respect to the longitudinal midpoint of the ground mat 2, and the golfer's up-range foot 14 is placed and positioned at a maximum up-range distance from such line. The ball 10 is placed in alignment with lateral line 4 at an intermediate reach distance between the minimum and maximum set for the pitching wedge and driver.

The ball and foot placements of FIG. 7 in relation to the mat 2 are graphically symbolic of a proper ball address during use of the high loft club series' lowest loft club, e.g. the six iron. The maximal up-range placement of the up-range foot 14 beneficially frames and limits the golfer's similar foot placements during use of the other high loft series clubs. FIG. 7's maximum up-range placement of foot 14 aids in establishing proper intermediate up-range foot placements for the other high loft clubs, e.g. the seven, eight, and nine irons.

Figure 6:
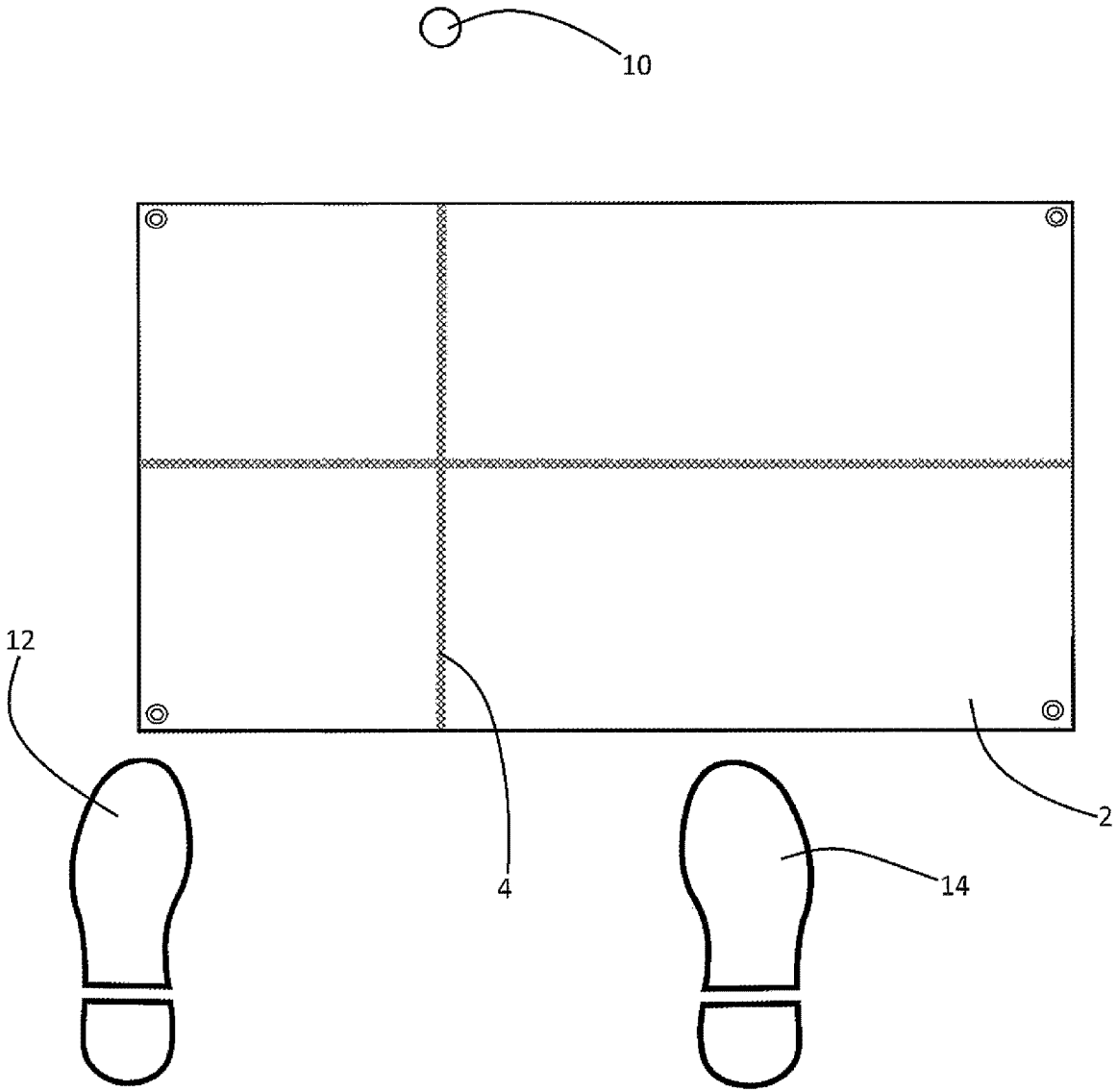
FIG. 6 is a diagram showing utilization of the instant inventive method in training of a golfer's ball address while alternatively using a five iron.

Referring to FIG. 6, upon the golfer's selection of the low loft club series' highest loft club, e.g. the five iron club, the golfer orients the mat 2 so that its lateral line 4 is down-range from the mat's longitudinal midpoint. Thereafter, similarly with the golfer's greatest or maximum up-range placement of her up-range foot 14, the golfer places her down-range foot 12 a greatest or maximum down-range distance from the re-positioned lateral line 4. In establishing such greatest down-range distance of the down-range foot 12, as indicated in FIG. 6, the golfer may easily and conveniently note such placement and distance in relation to the lateral line 4.

In each usage of the mat 2, the ball 10 is placed in substantial alignment with the lateral line 4. The maximal down-range placement of the golfer's down-range foot 12 is beneficially graphically symbolized by the pattern established in FIG. 6, such pattern assisting in setting down-range foot placements without use of the mat 2. The maximum or greatest status of FIG. 6's down-range foot placement also assists in establishing down-range foot placements for the low loft series' other clubs, e.g. the three wood, five wood, three iron, and four iron clubs.

Figure 4:
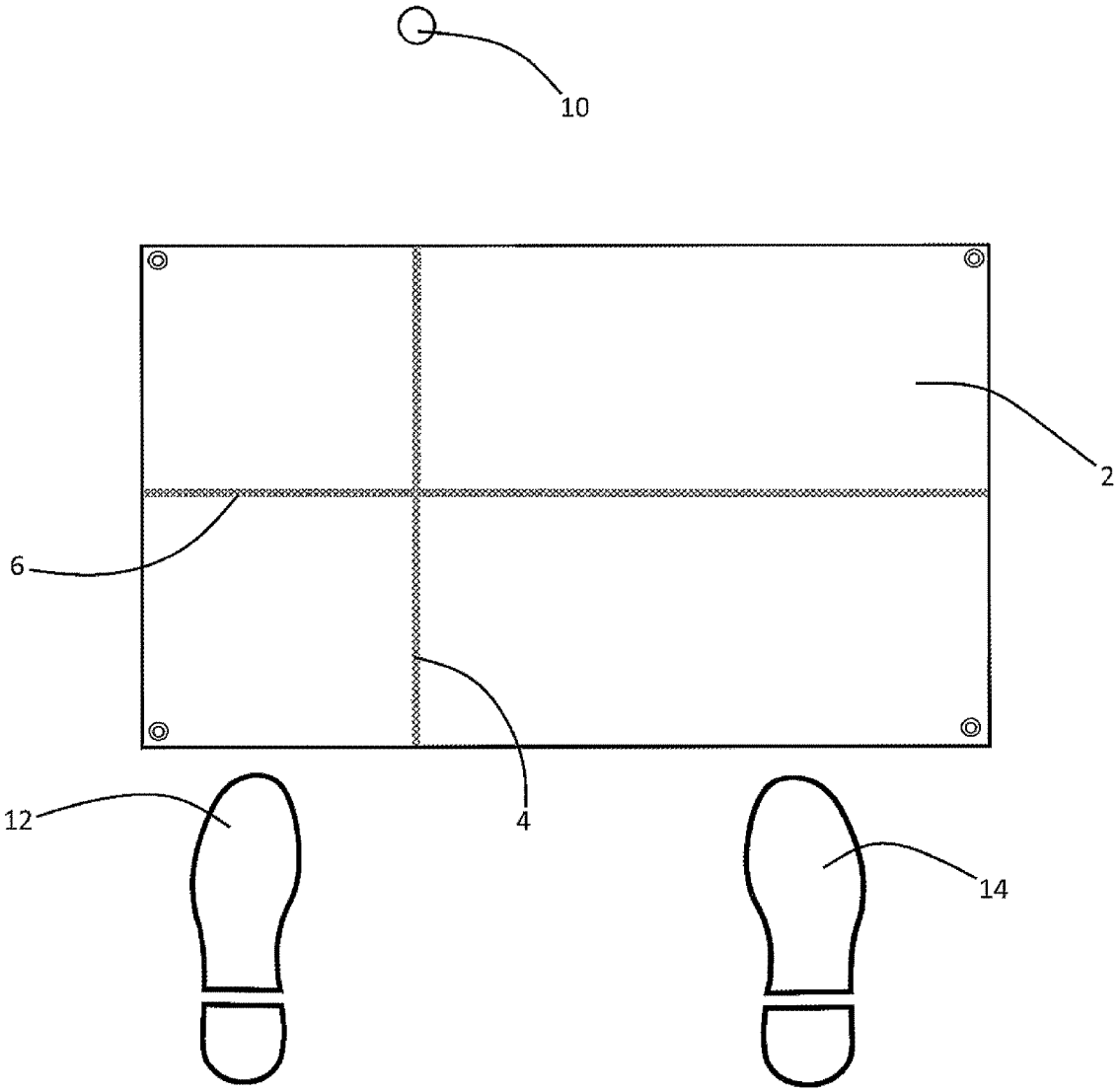
FIG. 4 is a diagram showing utilization of the instant inventive method in training of a golfer's ball address while alternatively using a three iron.
Figure 9:
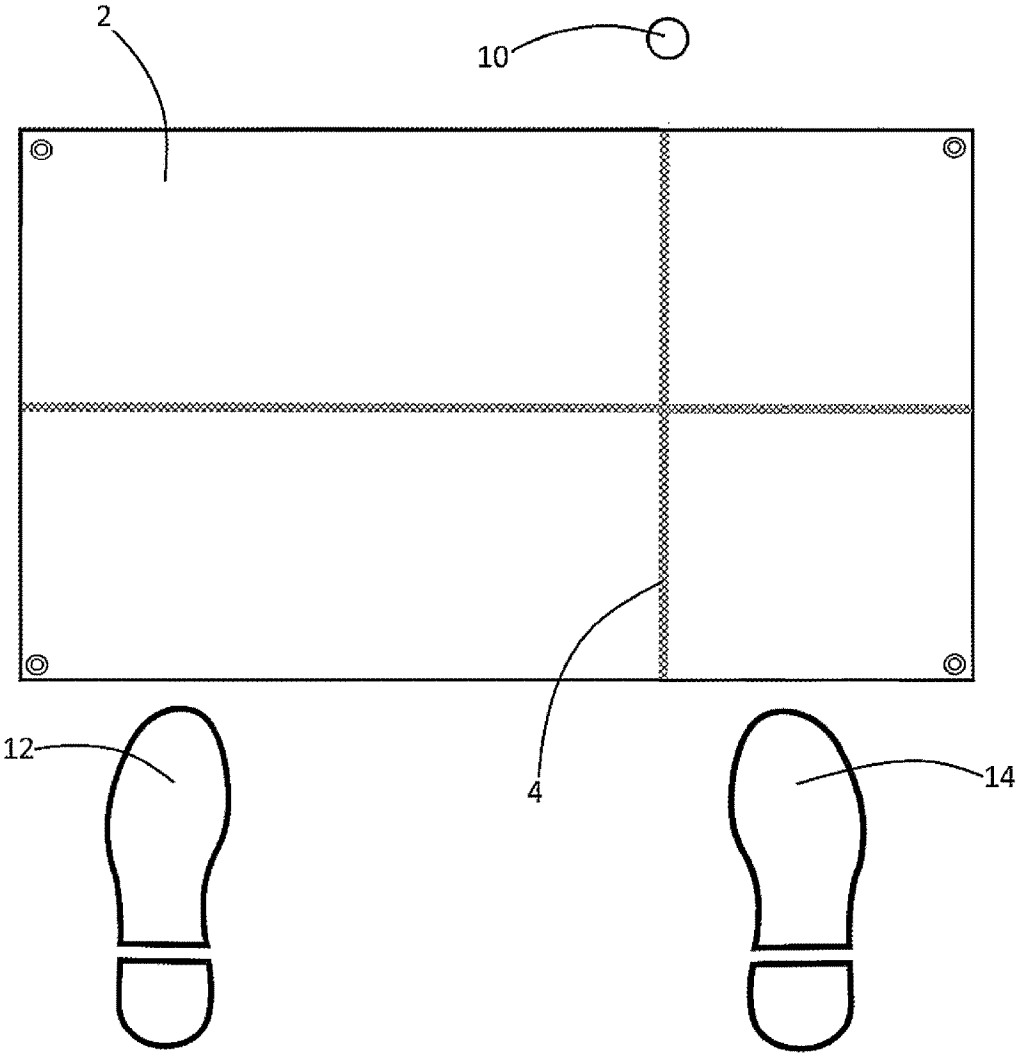
FIG. 9 is a diagram showing utilization of the instant inventive method in training of a golfer's ball address while alternatively using an eight iron.

Referring to FIG. 4, the golfer's selection of a low loft club series' intermediate loft club, e.g. the three iron, entails a down-range placement of her down-range foot 12 with respect to lateral line 4 which is less than the maximum established in use of the five iron. Referring further to FIG. 9, the golfer's alternate selection of a high loft club series intermediate loft club, e.g. the eight iron, similarly entails an up-range placement of her up-range foot 14 which is less than the maximum established in use of the six iron. Accordingly, both low loft club series and the high loft club series utilize the mat 2 for establishing minimum and maximum down-range and up-range foot placements, beneficially framing and guiding intermediate foot placements associated with those series intermediate loft clubs.

Figure 2:
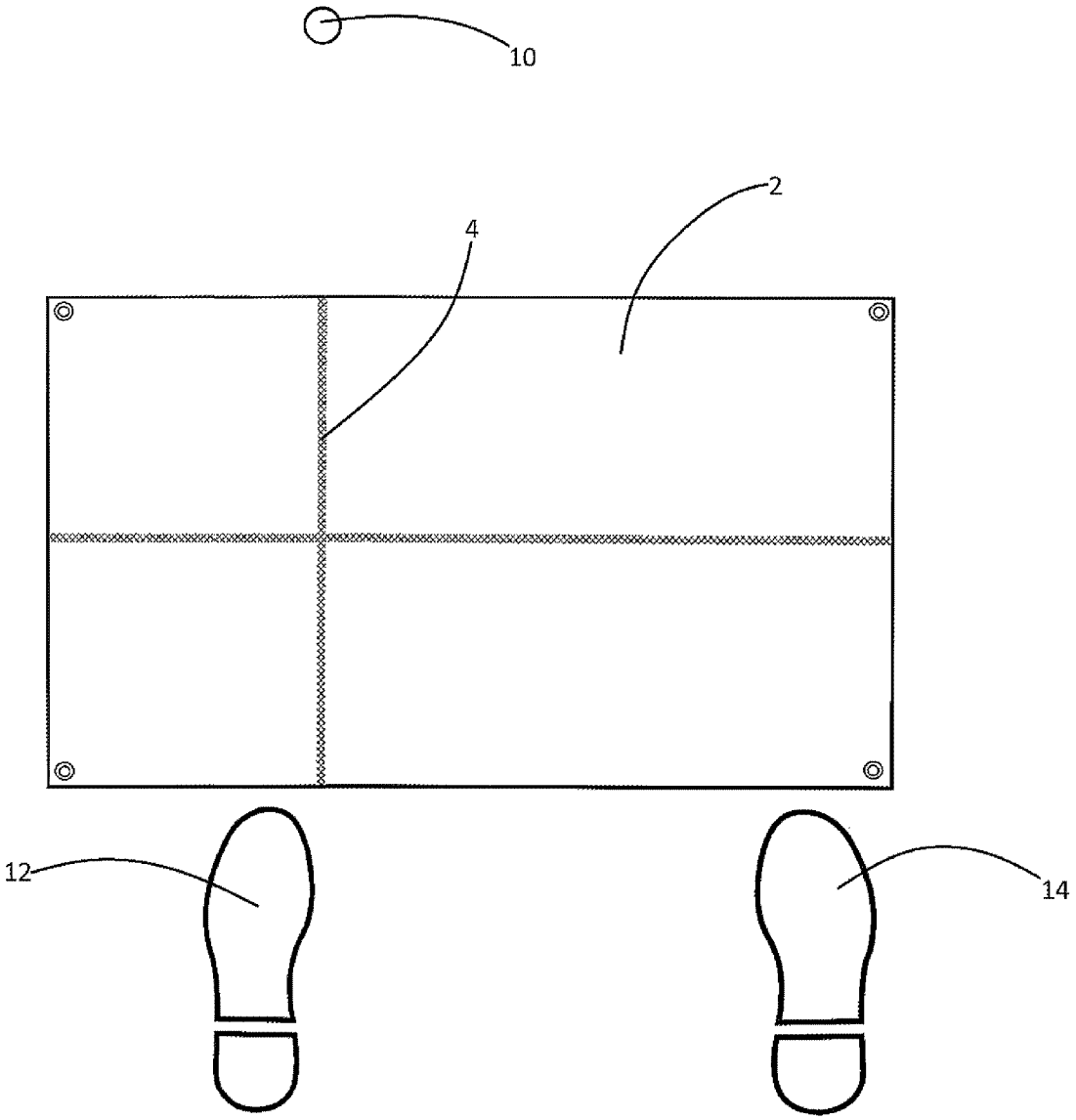
FIG. 2 is a diagram showing utilization of the instant inventive method in training of a golfer's ball address while alternatively using a three wood.
Figure 3:
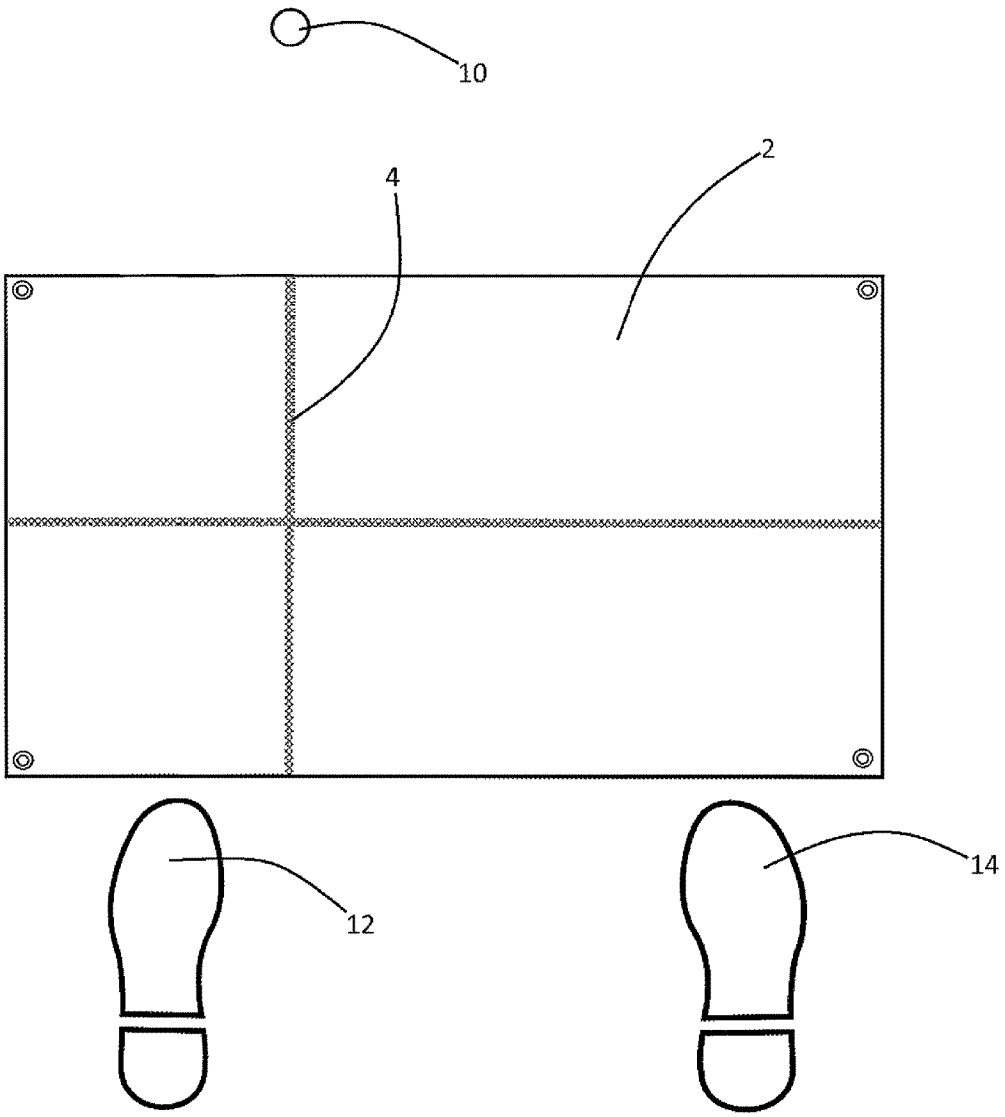
FIG. 3 is a diagram showing utilization of the instant inventive method in training of a golfer's ball address while alternatively using a five wood.
Figure 5:
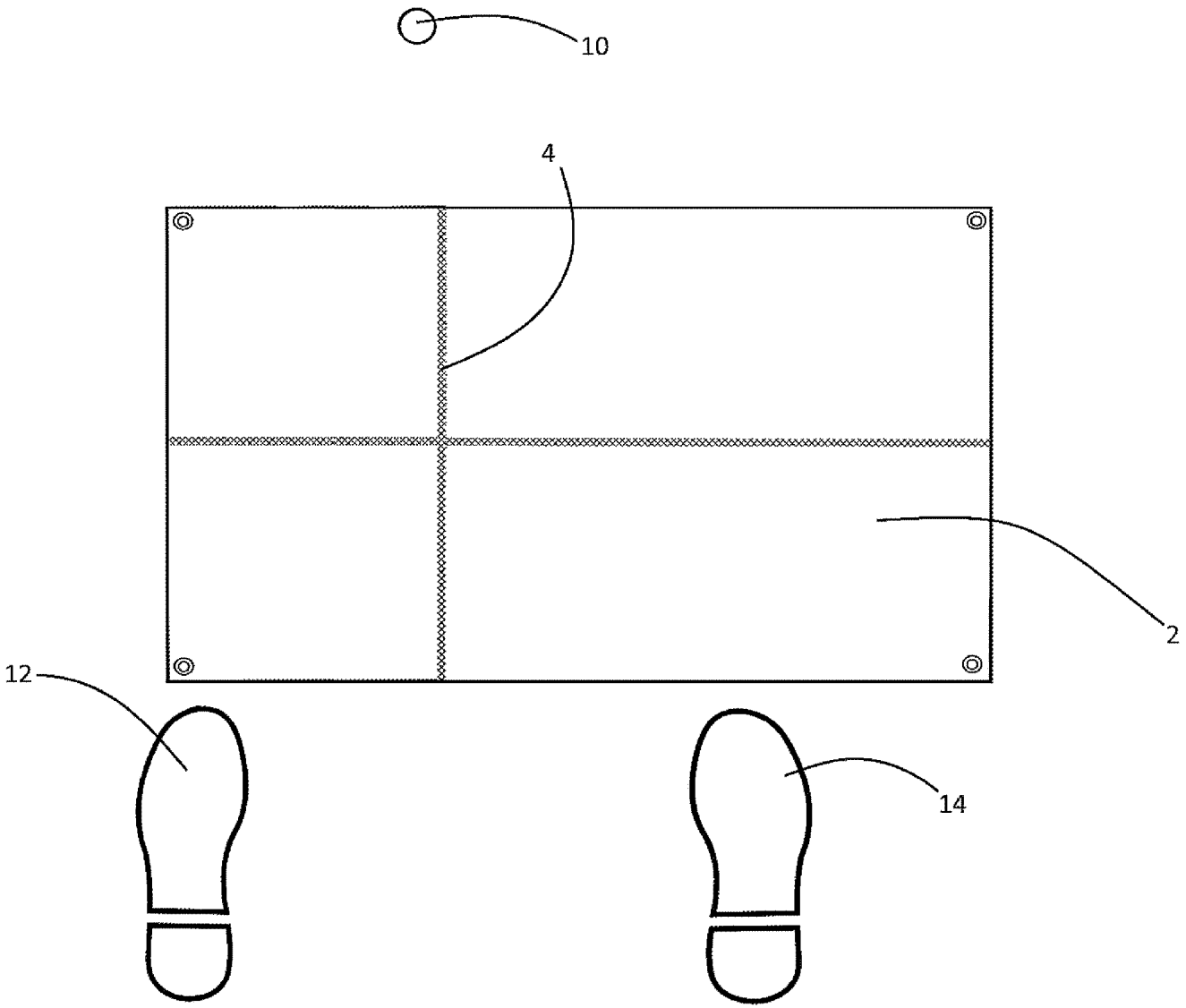
FIG. 5 is a diagram showing utilization of the instant inventive method in training of a golfer's ball address while alternatively using a four iron.
Figure 8:
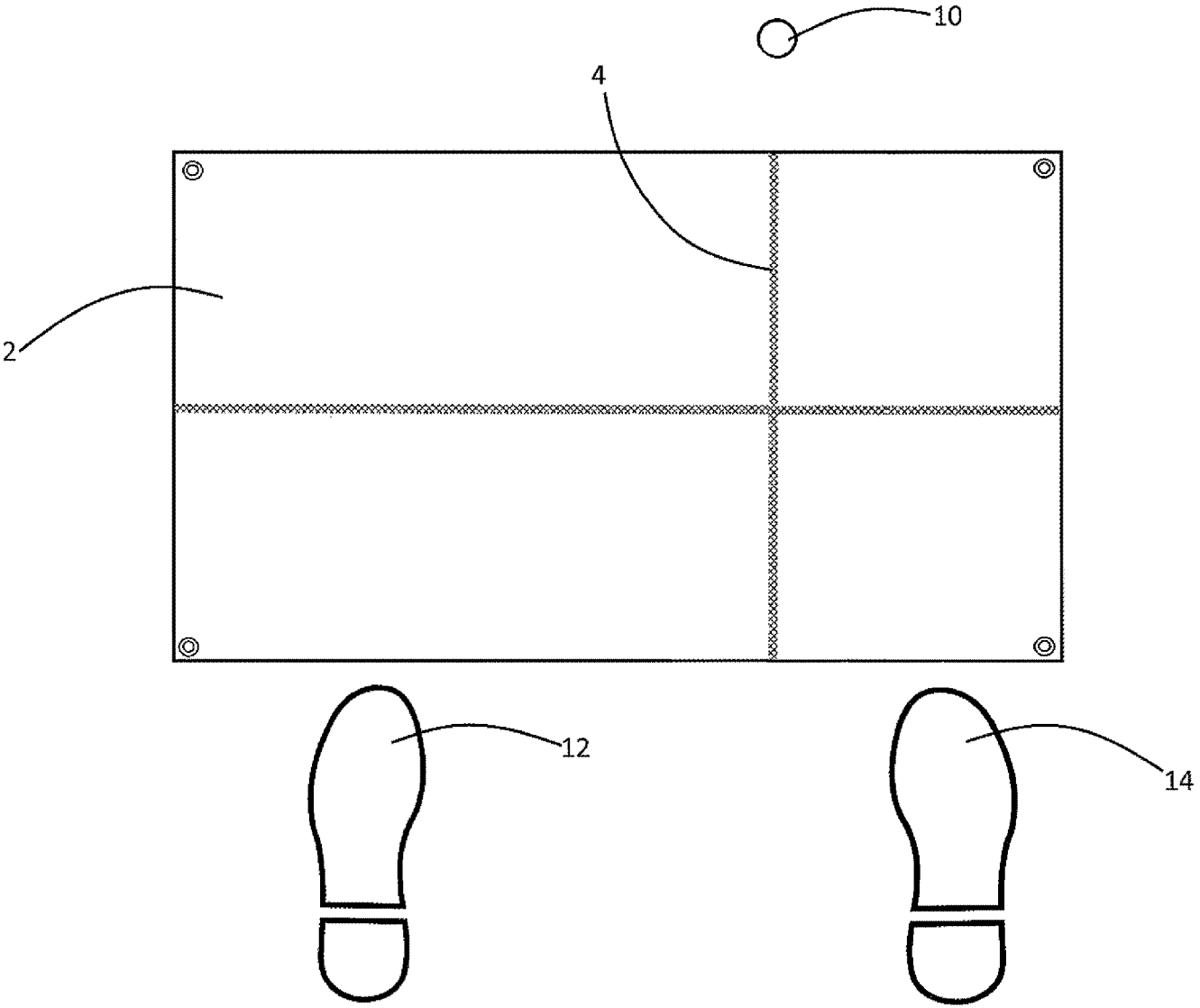
FIG. 8 is a diagram showing utilization of the instant inventive method in training of a golfer's ball address while alternatively using a seven iron.
Figure 10:
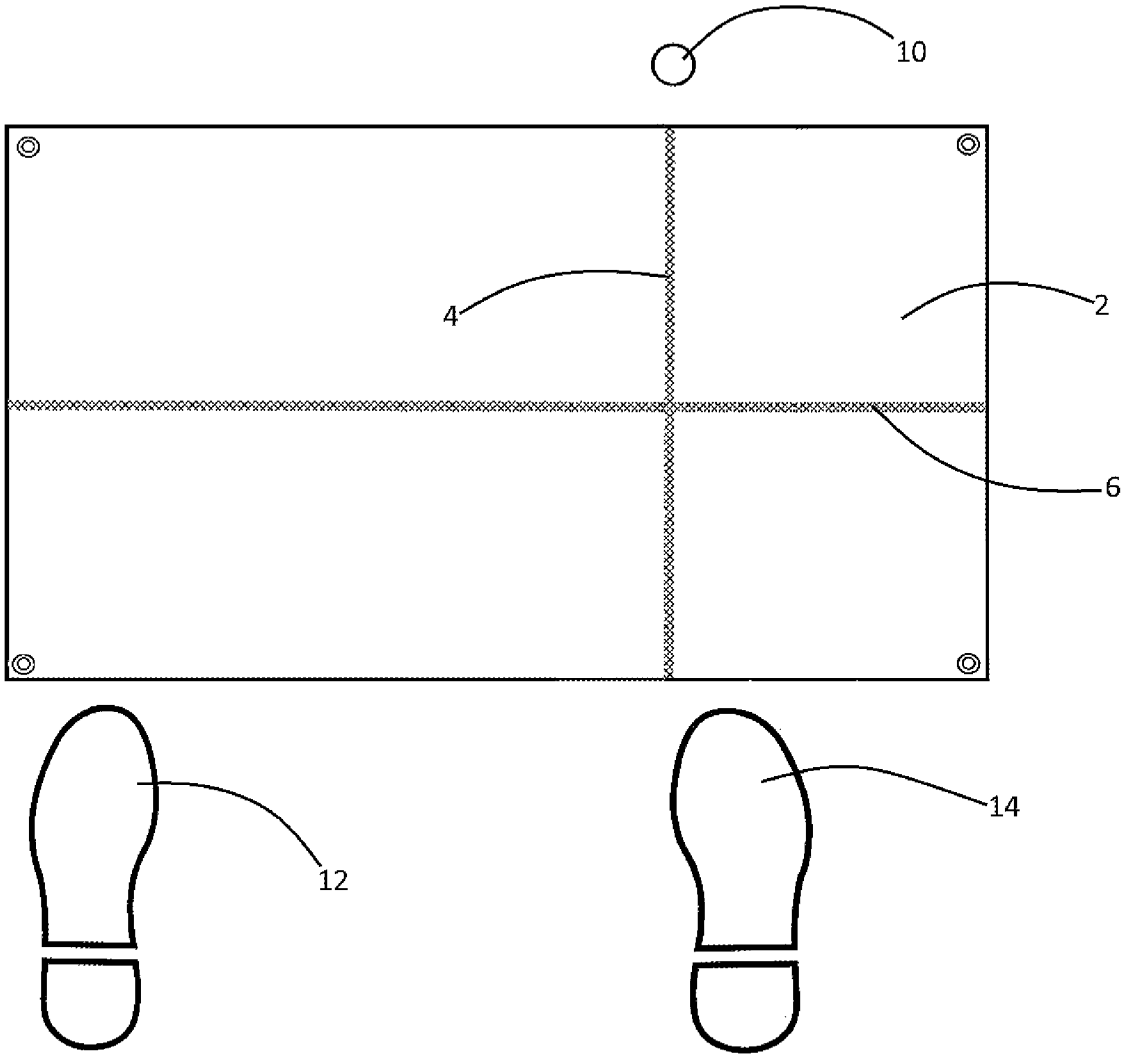
FIG. 10 is a diagram showing utilization of the instant inventive method in training of a golfer's ball address while alternatively using a nine iron.

The second intermediate down-range foot placements of the golfer's down-range foot 12 represented by FIGS. 2, 3, and 5 are associated with the golfer's respective selections of her three wood, her five wood, and five iron clubs, such clubs constituting a plurality of second intermediate loft clubs among the low loft club series. The second intermediate up-range foot placements of the golfer's up-range foot 14 represented by FIGS. 8 and 10 are similarly associated with the golfer's respective selections of her seven iron and nine iron clubs, such clubs constituting a plurality of second intermediate loft clubs among the high loft club series. The golfer's down-range intermediate placements of her down-range foot 12 preferably move progressively and evenly in accordance with the progression of loft angles of the intermediate and second intermediate clubs among the low loft club series. A correspondingly up-range progression is preferably followed in up-range foot placements upon selections of the intermediate and second intermediate clubs of the golfer's high loft club series.

Through repeated use of the mat 2 during the golfer's golf swing training uses of her high loft and low loft club series, foot placements and ball placements guided by the mat in performances of the method are readily translated by the golfer to uses of the same club without the mat. The progressive reach distances established in use of the mat 2 also beneficially serve as a check against the golfer's errors in setting a reach in her golf ball addresses.

While the principles of the invention have been made clear in the above illustrative embodiment, those skilled in the art may make modifications in the structure, arrangement, portions and components of the invention's assembly without departing from those principles. Those skilled in the art may also modify the invention's method steps including changes to their identity, character, and sequence of performance without departing from those principles. Accordingly, it is intended that the description and drawings be interpreted as illustrative and not in the limiting sense, and that the invention be given a scope at least commensurate with the appended claims.

The invention hereby claimed is:

1. A method for training a golfer's golf ball address, the golfer having a down-range foot and an up-range foot, said method comprising the golfer's performance of steps of:

(a) accessing a golf club set comprising a high loft club series and a low loft club series; wherein the high loft club series comprises a highest loft club among said series, a lowest loft club among said series, and an intermediate loft club among said series; and wherein the low loft club series comprises a highest loft club among said series, a lowest loft club among said series, and an intermediate loft club among said series;

(b) accessing a longitudinally oblongated ground mat having a longitudinal midpoint and a lateral line spaced away from said midpoint; and (c) selecting a golf club from the group consisting of the high loft club series' highest loft club, the low loft club series' lowest loft club, the high loft club series' lowest loft club, the low loft club series' highest loft club, the high loft club series' intermediate loft club, and the low loft club series' intermediate loft club; wherein (d) upon a selection of the high loft club series' highest loft club, the golfer moves the mat to an orientation wherein the lateral line is up-range from the midpoint, places a golf ball in alignment with the lateral line, and places the up-range foot in alignment with the lateral line;

(e) upon a selection of the low loft club series' lowest loft club, the golfer moves the mat to an orientation wherein the lateral line is down-range from the midpoint, places the golf ball in alignment with the lateral line, and places the down-range foot in alignment with the lateral line;

(f) upon a selection of the high loft club series' lowest loft club, the golfer moves the mat to an orientation wherein the lateral line is up-range from the midpoint, places the golf ball in alignment with the lateral line, and places the up-range foot a greatest up-range distance from the lateral line;

(g) upon a selection of the low loft club series' highest loft club, the golfer moves the mat to an orientation wherein the lateral line is down-range from the midpoint, places the golf ball in alignment with the lateral line, and places the down-range foot a greatest down-range distance from the lateral line;

(h) upon a selection of the high loft club series' intermediate loft club, the golfer moves the mat to an orientation wherein the lateral line is up-range from the midpoint, places the golf ball in alignment with the lateral line, and places the up-range foot an intermediate up-range distance from the lateral line; and (i) upon a selection of the low loft club series' intermediate loft club, the golfer moves the mat to an orientation wherein the lateral line is down-range from the midpoint, places the golf ball in alignment with the lateral line, and places the down-range foot an intermediate down-range distance from the lateral line.

2. The method of claim 1 wherein, upon the selection of high loft club series' highest loft club, the placing the golf ball in alignment with the lateral line step positions the golf ball a least distance from the mat.

3. The method of claim 2 wherein, upon the selection of the low loft club series' lowest loft club, the placing the golf ball in alignment with the lateral line step positions the golf ball a greatest distance from the ground mat.

4. The method of claim 3 wherein, upon the selection of a club among the high loft and low loft club series other than those series' respective highest and lowest loft clubs, the placing the golf ball in alignment with the lateral line steps position the golf ball intermediate distances from the ground mat.

5. The method of claim 4 wherein the high loft club series comprises a plurality of second intermediate loft clubs.

6. The method of claim 5 wherein the low loft club series comprises another plurality of second intermediate golf clubs.

7. The method of claim 6 wherein the ground mat comprises a longitudinally extending aim line which substantially perpendicularly intersects the lateral line.

8. The method of claim 7 wherein the ground mat comprises a plurality of golf tee receiving eyes, each of said eyes opening at a corner of the ground mat.

9. The method of claim 8 wherein each ground mat orientation step comprises downward extensions of golf tees through the golf tee receiving eyes for anchoring said mat upon the ground.

* * * * *